US009295986B2

(12) United States Patent
Wilmer et al.

(10) Patent No.: US 9,295,986 B2
(45) Date of Patent: Mar. 29, 2016

(54) PIPETTE WITH RELEASABLE LOCKING OF ROTATIONAL POSITION OF ACTUATING ELEMENT

(71) Applicant: Eppendorf AG, Hamburg (DE)

(72) Inventors: Jens Wilmer, Ahrensburg (DE); Ingo Winter, Henstedt-Ulzburg (DE)

(73) Assignee: EPPENDORF AG, Hamburg (DE)

( * ) Notice: Subject to any disclaimer, the term of this patent is extended or adjusted under 35 U.S.C. 154(b) by 332 days.

(21) Appl. No.: 13/873,755

(22) Filed: Apr. 30, 2013

(65) Prior Publication Data

US 2013/0291660 A1 Nov. 7, 2013

Related U.S. Application Data

(60) Provisional application No. 61/641,494, filed on May 2, 2012.

(51) Int. Cl.
*B01L 3/02* (2006.01)

(52) U.S. Cl.
CPC ..... *B01L 3/021* (2013.01); *B01L 3/0224* (2013.01); *B01L 2200/14* (2013.01); *B01L 2300/026* (2013.01)

(58) Field of Classification Search
CPC ..... B01L 3/021; B01L 3/0224; B01L 3/0279; B01L 2200/023; B01L 2200/028; B01L 2200/087; B01L 2200/14; B01L 2300/26; G01F 11/027
USPC ..... 73/864.11, 864.13; 422/100
See application file for complete search history.

(56) References Cited

U.S. PATENT DOCUMENTS

| | | | | |
|---|---|---|---|---|
| 3,827,305 | A | 8/1974 | Gilson et al. | |
| 4,020,698 | A | 5/1977 | Marteau D'Autry | |
| 5,531,131 | A | 7/1996 | Sabloewski | |
| 6,019,004 | A * | 2/2000 | Conley et al. | 73/864.16 |
| 6,428,750 | B1 * | 8/2002 | Rainin et al. | 422/516 |
| 7,204,163 | B2 * | 4/2007 | Uldry et al. | 73/864.18 |
| 2012/0148459 | A1 * | 6/2012 | Sarna et al. | 422/516 |

FOREIGN PATENT DOCUMENTS

| | | | |
|---|---|---|---|
| CN | 1423747 | | 6/2003 |
| DE | 43 35 863 | C1 | 2/1995 |
| EP | 0 085 854 | A2 | 8/1983 |
| EP | 0 155 087 | A2 | 9/1985 |
| EP | 0 527 170 | B1 | 2/1993 |
| FR | 2 203 680 | A1 | 5/1974 |
| WO | 91/16976 | A1 | 11/1991 |
| WO | 01/61308 | A1 | 8/2001 |
| WO | 03/033151 | A1 | 4/2003 |

* cited by examiner

*Primary Examiner* — Hezron E Williams
*Assistant Examiner* — David Z Huang
(74) *Attorney, Agent, or Firm* — Vidas, Arrett & Steinkraus, P.A.

(57) ABSTRACT

A pipette for use with pipette tips in which a set metering volume is secured in that the locking body is arranged on the circumference of the annular cylindrical locking element when it is in the locking position. Through this, the transmission part which the locking element comprises on the outer circumference is held fast. The annular cylindrical locking element can be formed separately from a toothed ring for driving a counter mechanism. Thus, it is possible to perform the locking in arbitrary positions or in more selectable rotational positions than in the conventional locking equipment, where a locking element engages into the toothed ring for driving the counter mechanism.

18 Claims, 19 Drawing Sheets

4
14
24
23
16
20,21
15
103
22
12
11
13
19
11
18
17
2
9
25
26
6
III
III
27
10
23
28
30
38
44
78
39
35,34
40
31
41
33
42
32
43
72
10
81
36
74,75
79,80
67
37
64
63
65
68
68
70
58
46,54
47

CATCH SEGMENT UNLOCKED

PIPETTE WITH RELEASABLE LOCKING OF ROTATIONAL POSITION OF ACTUATING ELEMENT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a pipette for replaceable pipette tips.

Pipettes are used in the laboratory in particular for metering liquids. For this purpose, a pipette tip is clamped fast on a seat of the pipette with an upper opening. The seat is mostly a conical or cylindrical projection with respect to a casing of the pipette, onto which a pipette tip can be clamped with the upper opening thereof. The pipette tip can pick up and give out liquid through a lower opening. Air cushion pipettes comprise a displacement equipment for air, which is communicatingly connected to the pipette tip through a hole in the seat. An air cushion is relocated by means of the displacement equipment, so that liquid is sucked into the pipette tip and ejected out from there. For this purpose, the displacement equipment has a displacement chamber with a relocatable limit. The displacement equipment is mostly a cylinder with a piston that can be relocated therein.

After use, the pipette tips are released from the seat and replaced by a fresh pipette tip. Contaminations in subsequent meterings can be avoided through this. Pipette tips have usually an ejection device for ejecting the pipette tips, which permit ejection by actuation of a button without having to touch the pipette tips. Single use pipette tips made of plastics are available at low cost.

The relocatable limit is coupled to a drive equipment, which serves for shifting the piston in the cylinder. The drive equipment has a lifting rod, which can be shifted between an upper and a lower stop with a stop element. In the beginning of the aspiration of air into the displacement chamber, the stop element is situated at the lower stop. In the beginning of the displacement of air out of the cylinder, the stop element rests on the upper stop. The amount of liquid that is picked up or delivered, respectively, depends on the stroke of the relocatable limit, and thus on the stroke of the lifting rod. The stroke volume of the relocatable limit does not correspond exactly to the amount of liquid that is picked up or delivered. As the air column expands somewhat under the weight of the liquid, the stroke volume exceeds the volume of the liquid. The deviation between the stroke volume and the liquid's volume depends in particular on the density and viscosity of the liquid, the temperature, the air pressure and on wetting effects. For instance from the document WO 03/0331515 or U.S. Pat. No. 3,827,305, it is known to calibrate pipettes to a certain metering volume by adjusting the position of an upper stop body.

In fixed volume pipettes, the distance between upper and lower stop is constant. A fixed volume pipette with an upper stop body in the form of a threaded sleeve that is adjustable by a calibration tool is known from the document U.S. Pat. No. 4,020,698.

In pipettes with adjustable metering volume, the position of the upper stop is variable. Known pipettes have an upper stop body in the form of a threaded spindle, which is adjustable in a spindle nut which is fixedly disposed in the casing. In order to adjust the threaded spindle, there are adjustment equipments, which are coupled to indicating equipments in the form of a counter for indicating the set metering volume.

The documents DE 43 35 863 C1 and U.S. Pat. No. 5,531,131 describe a pipette where a cylindrical actuating element projects out of the casing at the top, and is connected to an upper end of a lifting rod that is connected to the piston at its lower end. The lifting rod is guided through the upper passage channel of a threaded spindle and the lower passage channel of a lower stop body. It comprises a stop element in the form of an outward projecting bead, which limits the movement of the lifting rod between the threaded spindle and the lower stop body. By pressing in the actuating element against the force of a pull back spring, the piston is moved deeper into the cylinder, until the stop element bears against the lower stop body. After releasing the actuating element, the piston reverts into its starting position due to the action of the pull back spring, in which the stop element bears against the threaded spindle. Adjustment equipments for adjusting the threaded spindle comprise an adjusting sleeve, which projects out of the casing at the top and in which the actuation button can be relocated axially. The adjusting sleeve is rotatably mounted in the casing and connected to the upper end of the threaded spindle via catch dogs so as to rotate together with it. By rotating the adjusting sleeve, the threaded spindle can be relocated together with the spindle nut, wherein the catch dogs are axially relocatable in axial grooves of the adjusting sleeve.

Moreover, pipettes are known in which a cylindrical actuating element serves as an adjusting element for adjusting the threaded spindle at the same time. For this purpose, the actuating element is connected to the upper end of the threaded spindle so as to rotate with it and to be axially relocatable. A driving tenon in the form of a polygon on the upper end of the threaded spindle immerses into a complementary axial accommodation of the actuating element. The actuating element is relocatably arranged in a break-through of a sleeve-shaped transmission part, which is rotatably mounted in the casing. The actuating element is connected to the transmission part so as to be rotationally blocked via catch dogs in the form of ribs that project outward engaging into axial grooves of the transmission part. The transmission part has a toothed ring with axially projecting teeth on its circumference at the outside, into which a toothed wheel of a counter mechanism engages which serves for indicating the set metering volume.

The known pipettes have a locking equipment which prevents that a set metering volume is changed without intention in the metering. For this purpose, an axially directed tooth on a lever arm of a two-arm lever, which is pivotal around a horizontal axis, engages between two neighbouring axially directed teeth of a toothed ring on the circumference of the transmission part. The lever is pressed into this locking position via a spring. In order to unlock, there is a push button which partly projects out of the casing and acts within the casing on the other lever arm of the lever via a chamfered surface. By pressing the push button deeper into the casing, the lever is swung so that the tooth is released from the toothed ring. In this position, the actuating element can be rotated in order to adjust the metering volume. Such a locking of the rotational position of the actuating element is described in the document EP 0 527 170 B1.

The known locking equipment has the disadvantage that it may be destroyed in the locking position by rotating the actuating element with increased force. Moreover, it is tedious to push the unlocking push button and to adjust the metering volume at the same time. Moreover, actuating the wedge gear system formed by the push button and the lever requires a relatively high expenditure of force. Further, the engagement of the tooth into the toothed ring of the transmission part limits the fineness of the setting of the metering volume. Moreover, the assembly of the many single parts is sumptuous.

BRIEF SUMMARY OF THE INVENTION

Starting from this, the present invention is based on the task to provide a pipette with a releasable locking of the rotational position of the actuating element which has favourable utilization properties.

The pipette of the present invention has

- a rod-shaped casing,
- a seat for detachably holding a pipette tip on the lower end of the casing,
- a displacement equipment, comprising a displacement chamber with a limit that is relocatable therein,
- a connection channel, connecting the displacement chamber with an opening in the seat,
- a drive equipment, coupled to the relocatable limit, for relocating the relocatable limit of the displacement chamber,
- adjustable means for limiting the relocation of the relocatable limit by the drive equipment,
- an actuating element, connected to the drive equipment and projecting out from the upper end of the casing, for controlling a relocation of the relocatable limit by relocation along an axis, and for adjusting the adjustable means for limiting by rotating the actuating element,
- a cylindrical transmission part, which is rotatable in the casing and bearing mounted at a certain position in the axial direction, wherein the actuating element is relocatable in an axially extending accommodation of the transmission part and is connected to the transmission part, so as to rotate together with it, via means for rotation-blocked connection,
- first means for transmitting a rotational movement of the actuating element to a movement for adjusting the adjustable means for limiting the relocation, coupled to the actuating element and the adjustable means for limiting the relocation,
- adjustable means for indicating a metering volume with a display that is visible from the outside,
- second means for transmitting a rotational movement of the transmission part to a movement for adjusting the adjustable means for indicating, coupled to the transmission part and the adjustable means for indicating,
- an annular cylindrical locking element on the outer circumference of the transmission part,
- a locking body with a partly cylindrical acting surface, which bears against the circumference of the locking element in the locking position,
- means for relocating the locking body into the locking position,
- at least one unlocking element, projecting from the casing and being movably mounted with respect to the casing,
- third means for transmitting a movement of the unlocking element with respect to the casing to a movement, away from the locking element, of the locking body from out the locking position, the means being coupled to the locking body and the unlocking element.

In the pipette of the present invention, a set metering volume is secured in that the locking body is arranged on the circumference of the annular cylindrical locking element when it is in the locking position. Through this, the transmission part which the locking element comprises on the outer circumference is held fast. The annular cylindrical locking element can be formed separately from the toothed ring for driving a counter mechanism. Thus, it is possible to perform the locking in arbitrary positions or in more selectable rotational positions than in the conventional locking equipment, where a locking element engages into the toothed ring for driving the counter mechanism. Errors in the setting of the metering volume are reduced through this. Further, finding a locking point is facilitated. The partial cylindrical acting surface of the locking body can be made greater than the one tooth of the locking lever in the state of the art. Thus, the locking can be overcome or destroyed less easily, and the safety of the locking is improved. Further, it is advantageous that the locking body, the unlocking element and the third means for transmitting a movement can be housed in a space-saving way above a toothed ring for driving a counter mechanism. In this, the third means for transmitting do not necessitate a wedge slide gear, which is impaired by friction and increases the force of operation.

According to one embodiment, the pipette has unlocking elements, projecting from the casing on side walls of the casing facing away from each other, each of them being coupled to the locking body via third means for transmitting, in order to relocate the locking body away from the locking element by actuating the one or the other unlocking element at option. This embodiment is particularly advantageous with respect to the utilization of the pipette by left handed and right handed persons, an easily reachable unlocking element being provided for both of them.

According to one embodiment, the locking element is a toothed ring on the circumference of the transmission part with radially outward directed teeth, and the locking body has a toothed ring with radially inward directed teeth on the partly cylindrical acting surface, which engage into the teeth of the locking element in the locking position. In another embodiment, the locking element is ferromagnetic and the locking body is a magnetic body. According to another embodiment, the locking element is a brake cylinder and the locking body is a brake shoe. The two first and the two last variants can also be used in combination.

The locking body has preferably at least 5 and/or at most 35 teeth, further preferably at least 15 and/or at most 25 teeth.

According to a further embodiment, the third means for transmitting comprise a two-arm lever with a first lever arm acting on the locking body and a second lever arm, which either acts on the unlocking element or is itself the unlocking element. This embodiment can be implemented in a space-saving way and permits force-saving unlocking. It favours designs wherein the locking body is brought into the locking position with exceptionally high force, so that the locking is particularly safe.

According to a further embodiment, the lever arms of the two-arm lever are inclined towards each other in an obtuse angle, and/or extend in an arc around the actuating element. This embodiment is also advantageous for space-saving accommodation around the transmission part.

According to a further embodiment, the unlocking element has a further lever, pivotally mounted in the casing, with a lever arm acting on the third means for transmitting and an actuating portion protruding from the casing. This embodiment permits a force conversion via a gear system composed of several lever arms, which facilitates unlocking. It favours designs wherein the locking body is brought into the locking position with exceptionally high force, so that the locking is particularly safe.

According to a further embodiment, means for arresting the further lever in an unlocking position exist between the further lever and the casing. This embodiment favours the adjustment of the metering volume by only one single hand, because the user can disengage the further lever in the unlocking position, and then easily turn the actuating element with thumb and forefinger.

According to a further embodiment, the means for relocating the locking body into the locking position comprise a spring element which loads the locking body in the locking position and is supported in a spring support that is fixedly connected to the casing. The spring element keeps the locking body in the locking position when the unlocking element is unloaded. Upon actuation of the unlocking element, the locking body is moved away from the locking position against the action of the spring element. After unloading the unlocking element, the spring element moves the locking body back into the locking position. Preferably, the spring element moves the third means for transmitting and the unlocking element also back into a starting position, from out which the unlocking can take place by actuating the unlocking element. According to a preferred embodiment, the spring element is a helical spring or a conical wire spring.

According to a further embodiment, there is a further spring element, which loads the unlocking element in the unlocking position and is supported in a spring support that is fixedly connected to the casing. The unlocking element can be actuated against the action of the further spring element, and is moved back into the unlocking position by the same after unloading.

In an alternative embodiment, the unlocking element can be actuated in two different directions, and the locking body is coupled to the unlocking element via the third means for transmitting, such that by actuating the unlocking element in the one direction, the locking body can be moved away from the locking position, and thus be unlocked, and that by actuating the unlocking element in the other direction, the locking body can be moved back into the locking position.

According to a further embodiment, the second means for transmitting comprise a toothed ring with axially directed teeth on the outer circumference of the transmission part, into which engages a toothed wheel of the means for indicating. Thus, this embodiment corresponds to the conventional pipette, but in difference to the conventional pipette, the annular cylindrical locking element is designed so as to be separate from the toothed ring with axially directed teeth. In the design of the annular cylindrical locking element as a toothed ring, it has preferably more teeth than the toothed ring with axially directed teeth. The number of teeth of the annular cylindrical locking element is preferably at least two times, further preferably three times as big as the number of teeth of the toothed ring with the axially directed teeth.

According to a further embodiment, the drive equipment comprises an axially relocatable lifting rod for relocating the relocatable limit of the displacement equipment, the adjustable means for limiting comprise an upper stop body, relocatable in the axial direction of the lifting rod, a lower stop body and a stop element, disposed on the circumference of the lifting rod between the upper and the lower stop body, for limiting the stroke of the lifting rod, and the actuating element is connected to the lifting rod. According to a preferred embodiment, there is a pull-back spring, which is supported in a spring support that is fixedly connected to the casing and which loads the drive mechanism in a starting position in which the stop element bears against the upper stop body.

The relocatable limit can be relocated into the displacement chamber by actuating the actuating element against the action of the pull-back spring, in order to eject fluid from the pipette tip. After unloading the actuating element, the pull-back spring moves the drive mechanism, and with it the relocatable limit, back into the starting position, in order to aspirate liquid into the pipette tip.

According to a further embodiment, the upper stop body is a threaded spindle which has an upper passage channel through which the lifting rod is guided through and which is screwed into a spindle nut that is fixedly connected to the casing, and the lower stop body has a lower passage channel through which the lifting rod extends, and the lifting rod with the stop element can be relocated between the upper stop body and the lower stop body. Alternatively, there is a toothed rack instead of a threaded spindle, which can be adjusted by way of a toothed wheel gear system and has the upper stop body at its lower end.

These embodiments of the drive equipment and of the adjustable means for limiting the relocation are constructionally simple and permit to set the metering volume accurately.

According to a further embodiment, the first means for transmitting are further means for connecting the actuating element to the threaded spindle so as to rotate together with it, which permit axial relocation of the actuating element with respect to the threaded spindle. Through this embodiment of the first means for transmitting, it is ensured that a rotational movement of the actuating element is transmitted to the threaded spindle, and the actuating element can be axially relocated with respect to the threaded spindle.

According to a further embodiment, the further means for connecting the actuating element to the threaded spindle so as to rotate together with it comprise a polygon which engages into a complementary, axially extending accommodation of the actuating element.

According to a further embodiment, one or several of the following component parts are entirely or partially mounted on a base board which is fixed in the casing: counter mechanism, counter gear system, locking body, lever, further lever, spring element and further spring element. The component parts can be pre-assembled on the base board, and the pipette can be equipped with the pre-assembled base board. An assembly gasket is achieved through this.

The pipette of the present invention is preferably a hand-held pipette. In this, it is dealt with a pipette which can be held and operated by the user with only one hand in the pipetting. The pipette is preferably a mechanically driven pipette. But in principle it is also possible to realise the pipette with an electric drive or with a mechanical drive having force assistance by an electric drive (servo drive).

The invention will be explained in more detail below by way of the attached drawings of an example of its realisation. In the drawings show:

BRIEF DESCRIPTION OF THE SEVERAL VIEWS OF THE DRAWINGS

FIG. 19 the same arrangement with unlocked locking equipment in the same perspective view;

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the present application, the designations "up" and "down", "above" and "below" and "horizontal" and "vertical" refer to an orientation of the pipette in which the casing is oriented vertically downward with the seat. In this orientation, a pipette tip fastened on the seat can be directed towards a vessel situated there under, in order to aspirate or to deliver a liquid.

Figure 1:
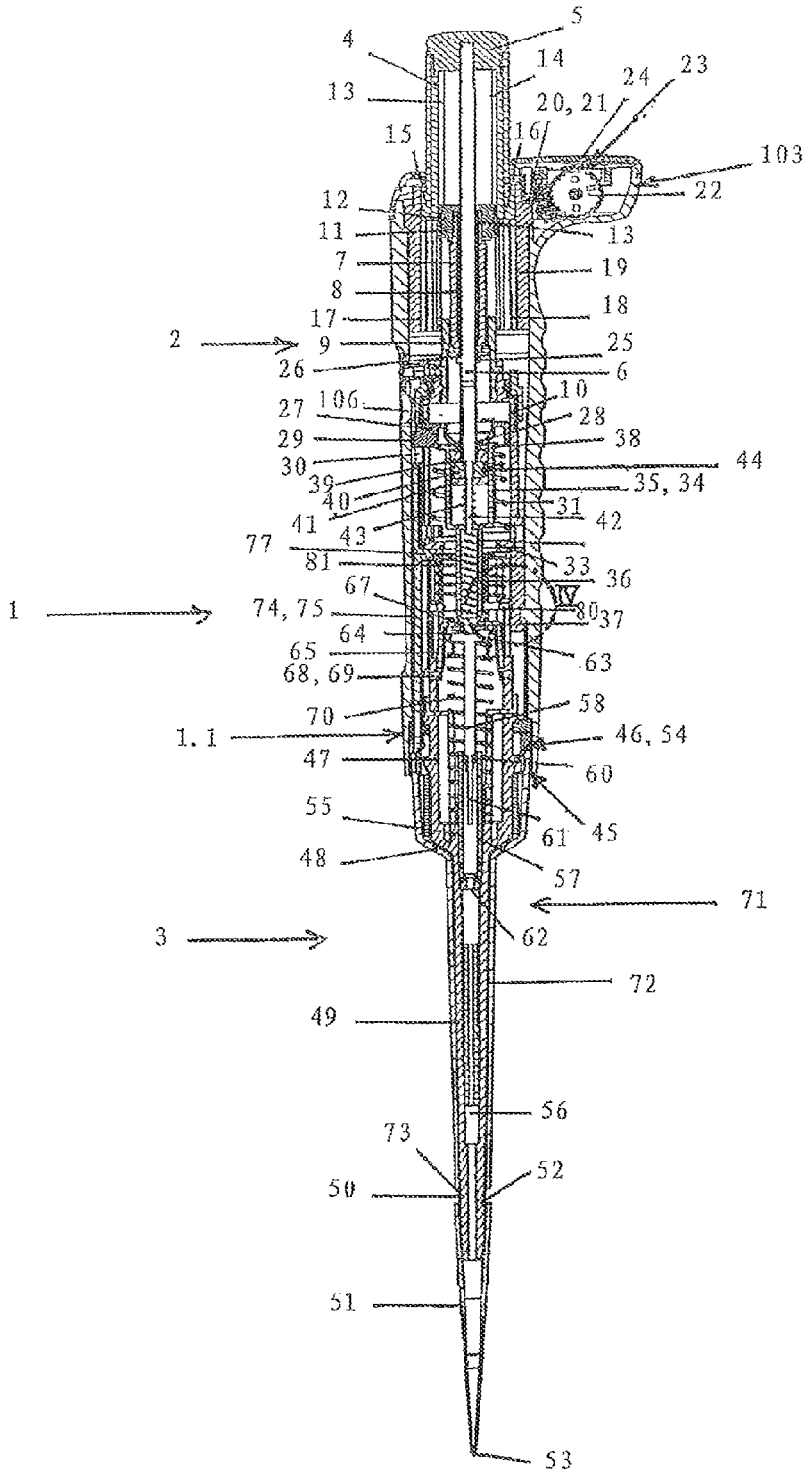
FIG. 1 a pipette of the present invention in a longitudinal section.
Figure 2:
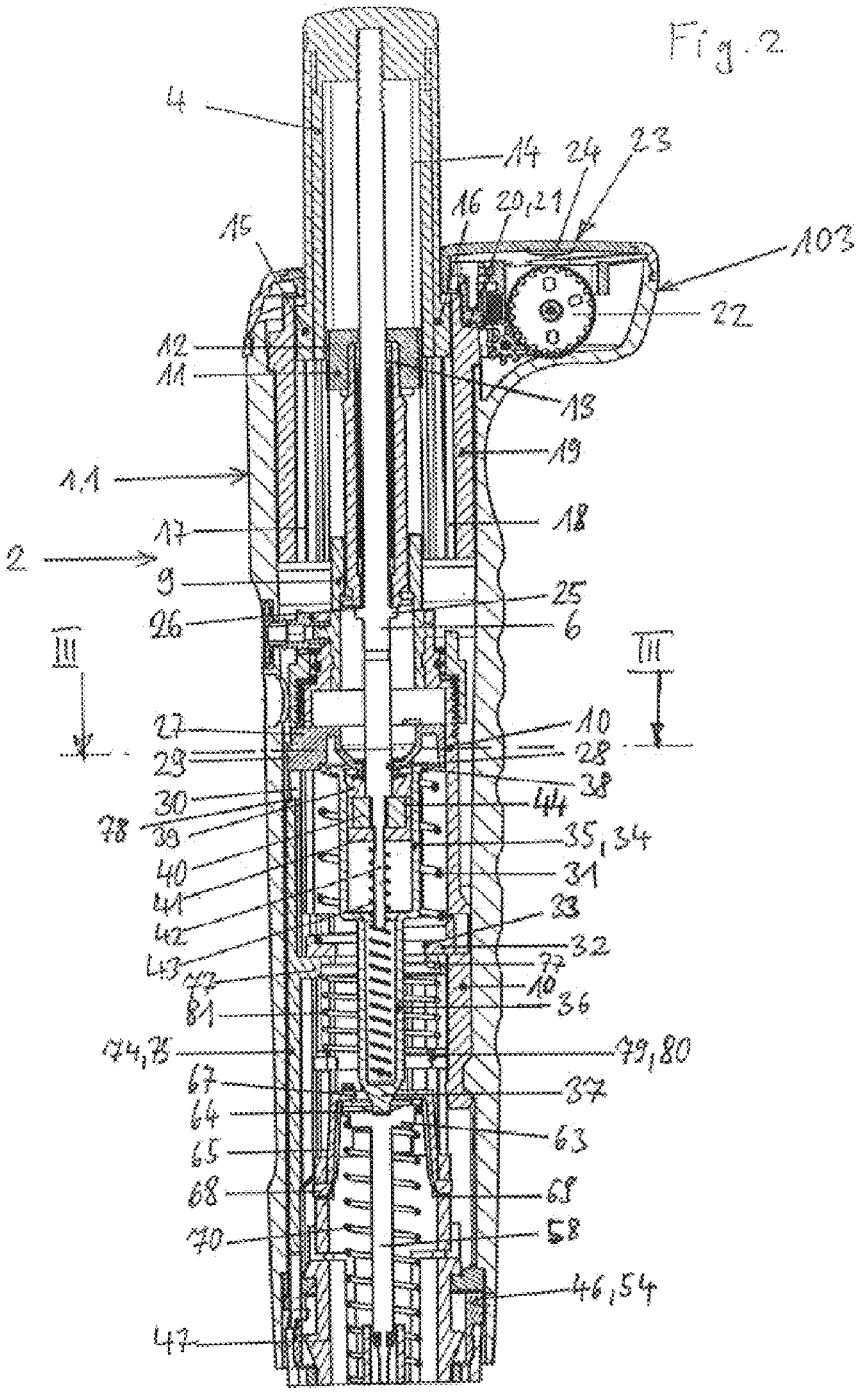
FIG. 2 the same pipette in a magnified longitudinal section through an upper portion.

According to FIGS. 1 and 2, the pipette 1 has a rod-shaped casing 1.1, formed as a handle, with an upper part 2 of the casing and a lower part 3 of the casing. The upper part 2 of the casing forms a drive unit with all the components contained therein, and the lower part 3 of the casing a displacer unit with all the components contained therein. An actuating element 4 in the form of a cylindrical push-button projects upward from the upper part 2 of the casing at the topside thereof. The actuating element 4 is mounted in the upper part 2 of the casing so as to be axially movable and rotatable.

The actuating element 4 is screwed fast on a cylindrical lifting rod 6 by a thread in a cover 5. In the upper part 2 of the casing, the lifting rod 6 is guided through an upper passage channel 7 of a threaded spindle 8. The threaded spindle 8 is screwed into an internal thread of a spindle nut 9 which is held in a defined position in the upper part 2 of the casing.

The spindle nut 9 is fixedly connected to a lifting body 10, which is fastened in the upper part 2 of the casing. The lifting body 10 is essentially cylindrical and is a carrier for the spindle nut 9, the threaded spindle 8 screwed in therein and the lifting rod 6 guided therein. When the pipette is being assembled, these and other component parts are pre-assembled on the lifting body 10, and the lifting body 10 equipped with the component parts is mounted in the upper part 2 of the casing, so that it is fixedly held in the upper part 2 of the casing. For this purpose, the lifting body 10 is latched with the upper part 2 of the casing. But in principle it is also possible to mount the component parts that are pre-assembled on the lifting body 10 directly in the upper part 2 of the casing. For this purpose, the upper part 2 of the casing can be configured at the inside corresponding to the lifting body 10.

At the topside, the threaded spindle 8 has a spindle driving tenon 11, connected to it so as to rotate together with it. On the circumference, the spindle driving tenon 11 has a hexagon 12 with central hole 13. The hexagon 12 engages into a hexagon socket 14 of the actuating element 4.

At the bottom, the actuating element 4 is provided with two diametrically opposite radial projections 15, 16, which project outwardly. There are preferably four radial projections 15, 16. The radial projections 15, 16 engage into axially running grooves 17, 18 at the inner side of a hollow cylindrical transmission part 19, which is rotatably mounted in the upper part 2 of the casing. At the top, the transmission part 19 has a toothed ring 20 on the circumference, which is engaged with a toothed wheel of a counter gear system 21, which drives several counter wheels 22, disposed side by side on a horizontal axis, of a counter mechanism 23. The counter mechanism 23 is fastened on the upper part of the casing. Each of the counter wheels 22 has numerals from 0 to 9. The rearmost counter wheel 22 with respect to FIG. 1 is driven by the counter gear system 21. The counter wheels 22 disposed aside are each turned further for one numeral when the counter wheel disposed behind them changes over from 9 to 0.

Above the counter mechanism 23, the upper part 2 of the casing has a casing cover 24 with a window, through which the numerals of the counter wheels 22 can be read out.

A bead-like collar 25 is disposed on the lifting rod 8 as a stop element below the threaded spindle 8. The relocation of the lifting rod 6 towards the upside is limited by bearing of the collar 25 against the lower front side 26 of the threaded spindle 8, which forms an upper stop body for the collar 25.

An essentially disc-shaped lower stop body 27 is disposed in the lifting body 10 below the spindle nut 9. The lower stop body 27 has a cup-shaped deepening, in which a lower passage channel 28 is centrally disposed. Further, the lower stop body 27 has several (for instance three or four) projections 29, radially projecting outwardly, which are uniformly distributed about its circumference.

Figure 3:
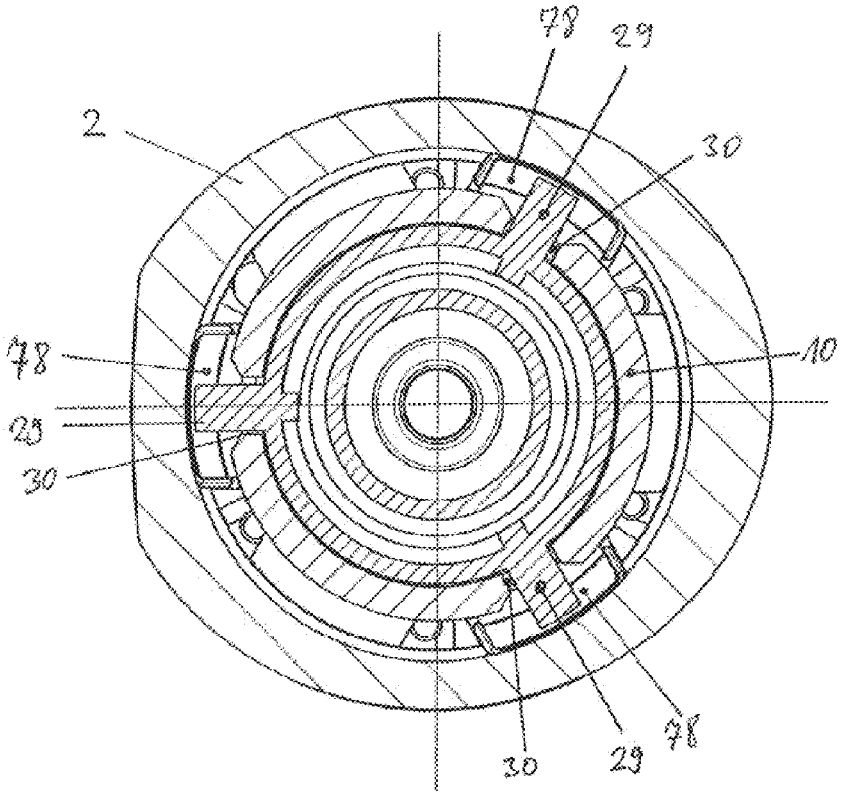
FIG. 3 an enlarged section along the line III-III of FIG. 2.

The lower stop body 27 is guided on the projections 29 in axially running guide slots 30 of the lifting body 10. This is also shown in FIG. 3. It can be relocated upwardly up to the abutment position of the projections 29 at the upper end of the guide slots 30.

An overstroke spring 31 realised as a helical spring is arranged in the lifting body 10 below the lower stop body 27. At the topside, the overstroke spring sits close on the bottom side of the lower stop body 27. At the downside, the overstroke spring 31 is supported on an overstroke spring support 32 which is disposed in the upper part 2 of the casing and fixedly connected to it.

The overstroke spring support 32 is formed by a ring with L-cross section, wherein the horizontal leg of the L-profile borders a central guide-through hole 33 of the overstroke spring support 32. The overstroke spring 31 is supported by the horizontal leg of the L-profile and is laterally enclosed by the vertical leg. The overstroke spring 31 pushes the lower stop body 27 against the upper ends of the guide slots 30 under bias with the projections 29.

Below the lower stop body 27, a drive element 34 in the form of a sleeve, aligned coaxially to the lifting rod 6, exists in the lifting body 10. The drive element 34 has an upper sleeve portion 35 and a lower sleeve portion 36, wherein the upper sleeve portion 35 has greater inner and outer diameters than the lower sleeve portion 36. The lower sleeve portion 36 has a tip 37 in the form of a truncated cone at the downside.

On the upper edge of the upper sleeve portion 35, there is a further circulating collar 38 which projects radially towards the outside. The outer diameter of the upper sleeve portion 35 is smaller than the inner diameter of the guide-through hole 33 of the overstroke spring support, 32, so that the lower and the upper sleeve portion 35, 36 can be introduced into the guide-through hole 33. The outer diameter of the further collar 38 exceeds the inner diameter of the guide-through hole 33, so that the drive element 34 cannot pass completely through the guide-through hole 33. The overstroke spring support 32 forms an end stop and the further collar 38 an end stop element, which limit the relocation of the drive element 34 towards the downside.

A hollow cylindrical anchor 39 made of a ferromagnetic material is disposed at the top of the upper sleeve portion 35. A hollow cylindrical magnet 40 is disposed there under in the upper sleeve portion 35. Below of it there is a pot 41, which accommodates the magnet 40. The anchor 39 has a press fit in the upper sleeve portion 35. The lifting rod 6 extends movably through the central hole of the anchor 39. Underneath of the anchor, the lifting rod 6 has a needle-shaped portion 42 with reduced diameter. The magnet 40 and the pot 41 sit on the needle shaped portion 42. Magnet 40 and pot 41 are preferably fixed on the needle-shaped portion 42, for instance by having a press fit there. Moreover, the magnet 40 is supported at its topside on a shoulder of the lifting rod, from which the needle shaped portion 42 emerges.

Below the ring disc 41, an uncoupling spring 43 realised as a helical spring is guided on the needle-shaped portion 42 and is supported on the bottom 43 of the lower sleeve portion 36. Anchor 39, magnet 40 and uncoupling spring 43 are component parts of an uncoupling device 44.

According to FIGS. 1, 2, 5 and 6, at the inner circumference next to a lower casing opening 45, the upper part 2 of the casing is provided with means 46 for detachable connection to further means for detachable connection to the lower part 3 of the casing, the means 46 not being explained in more detail.

The lower part 3 of the casing has a hollow cylindrical portion 47 at its topside, which is followed by a short upper hollow cone portion 48 with great cone angle at the downside, which is in turn followed by a long lower hollow cone portion 49 with small cone angle, which forms a conical neck 50 for clamping up a pipette tip 51 with its lower end. A clamped-up pipette tip 51 is also essentially conical with an upper opening 52 for plugging up onto the neck 50 and with a lower opening 53 for the passage of liquid. The upper opening 52 is significantly greater than the lower opening 53, and the pipette tip 51 tapers from the upper to the lower opening.

At the upper side on the outer circumference, the hollow cylindrical portion 47 of the lower part 3 of the casing is provided with further means for detachable connection 54 not explained in more detail, which are matched to the means 46 for detachable connection of the upper part 2 of the casing, in order to detachably connect the lower part 3 of the casing with the upper part 2 of the casing. Suitable means for detachable connection 64, 54 of the lower part 3 of the casing and the upper part 2 of the casing are described in the document DE 10 2004 003 434 B4. In this respect, it is made reference to DE 10 2004 003 434 B4 and US2005/155438 A, whose content is incorporated into the present application by reference.

At the top, the lower hollow cone portion 49 has a prolongation 55 in the lower part of the casing 3 which projects beyond the upper hollow cone portion 48.

The lower hollow cone portion 49 has a connection channel 56, which connects the upper front surface of the prolongation 55 with the lower front surface of the neck 50.

An arrangement of a cylinder 57 with a piston 58 relocatable therein is disposed in the lower part 3 of the casing. The cylinder 57 is set into the connection channel 56 with a lower area thereof, and fixed therein by pressing or gluing. At the bottom, the cylinder 57 is sealed with respect to the connection channel 56 by means of an O-ring 59.

The piston 58 has a piston seal 60 on its circumference, which seals on the cylinder 57 at the inside. Below the piston seal 60, the piston 58 has a needle-shaped extension 61 which can be introduced into a passage opening 62 in the bottom of the cylinder 57 and into the connection channel 56 in order to reduce the stagnant volume. Cylinder 57 and piston 58 are aligned vertically. At the top, the piston 58 has a horizontally directed piston disc 63, which has a vertically directed conical indentation 64 for receiving the tip 37 of the drive element 34 at its centre.

At its top, the lower part 3 of the casing has a pot-shaped closing cap 65 with a cylindrical or conical shell. The bottom of the closing cap 65 is disposed above the piston disc 63 and has a central upper casing opening 67, through which the piston disc 63 is accessible from the topside. On the edge of its shell, the closing cap 65 has outwardly projecting projections 68 which are snapped into corresponding indentations 69 of the hollow cylindrical portion 47 of the lower part 3 of the casing.

The bottom of the closing cap 65 limits the relocation of the piston 58 towards the upside. A piston spring 70, configured as a helical spring and being supported on the prolongation 55 at the bottom and on the bottom side of the piston disc 63 at the top, pre-loads the piston 58 against the bottom side of the closing cap 65.

The pipette 1 has further an ejection device 71. The ejection device 71 comprises an ejection slide 72, which is disposed on the lower part 3 of the casing. The ejection slide 72 has a contour that is adapted to the contours of the hollow cylindrical portion 47, the upper hollow cone portion 48 and the lower hollow cone portion 49. At the bottom, it has an annular ejection end 73. In the position of the ejection slide 72 of FIG. 1, the ejection end 73 is pushed up towards the upside onto the lower part 3 of the casing as far as possible, so that the conical neck 50 is free for plugging up a pipette tip 51.

At the topside, the ejection slide 72 is connected to an ejection lengthening 74. The latter comprises three vertical ejection rods 75, which are connected to the upper edge of the ejection slide 72. The ejection rods 75 are uniformly distributed over the upper edge of the ejection slide 72. At the bottom, the ejections rods 75 are connected via a first snap connection to an ejection ring 76, which is connected to the upper edge of the ejection slide 72 via a second snap connection. In a distance from the ejection ring 76, the ejection rods 75 are connected to each other by an annular upper ejection spring support 77 on their inner circumference at the top. The upper ejection spring support 77 has an L-shaped cross section, wherein the horizontal leg of the cross section is adjacent to the guide-through hole 33 below the overstroke spring support. The vertical, circulating leg of the upper ejection spring support 77 is directed downward.

The ejection rods 75 have actuating ends 78 at the top.

The ejection lengthening 74 or the ejection rods 75, respectively, extend into the upper part 2 of the casing through the lower casing opening 45. The relocation of the ejection lengthening 74 towards the upside is limited by the close sitting of the upper ejection spring support 77 on the bottom of the overstroke spring support 32.

Figure 4:
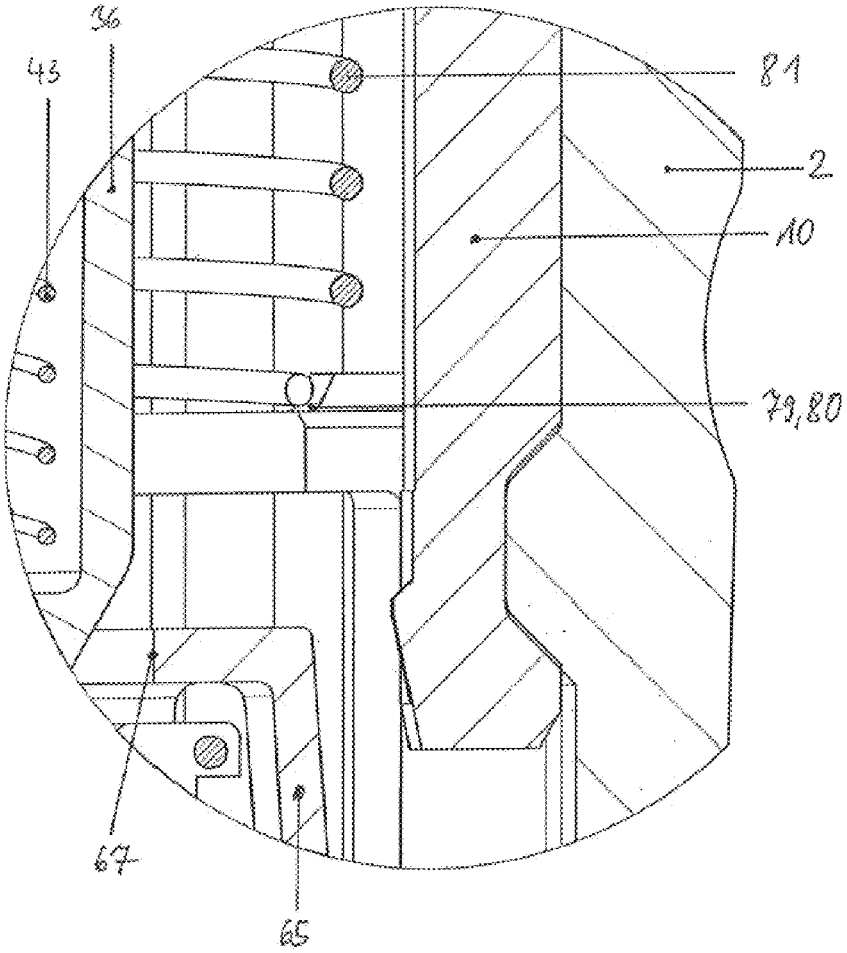
FIG. 4 a magnified detail IV of FIG. 2.
Figure 5:
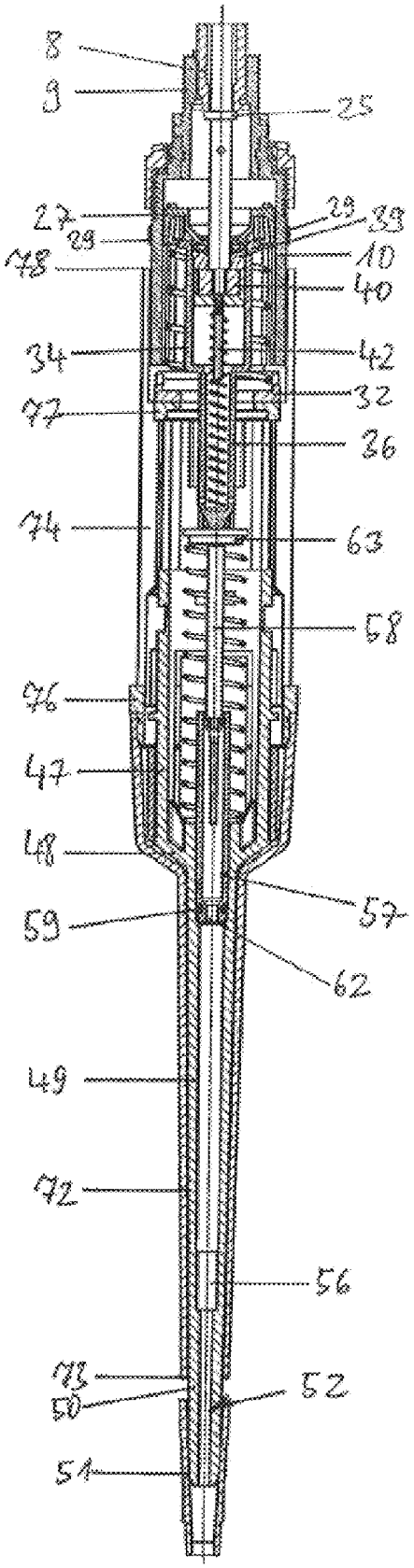
FIG. 5 the same pipette in a magnified longitudinal section through a lower portion.
Figure 6:
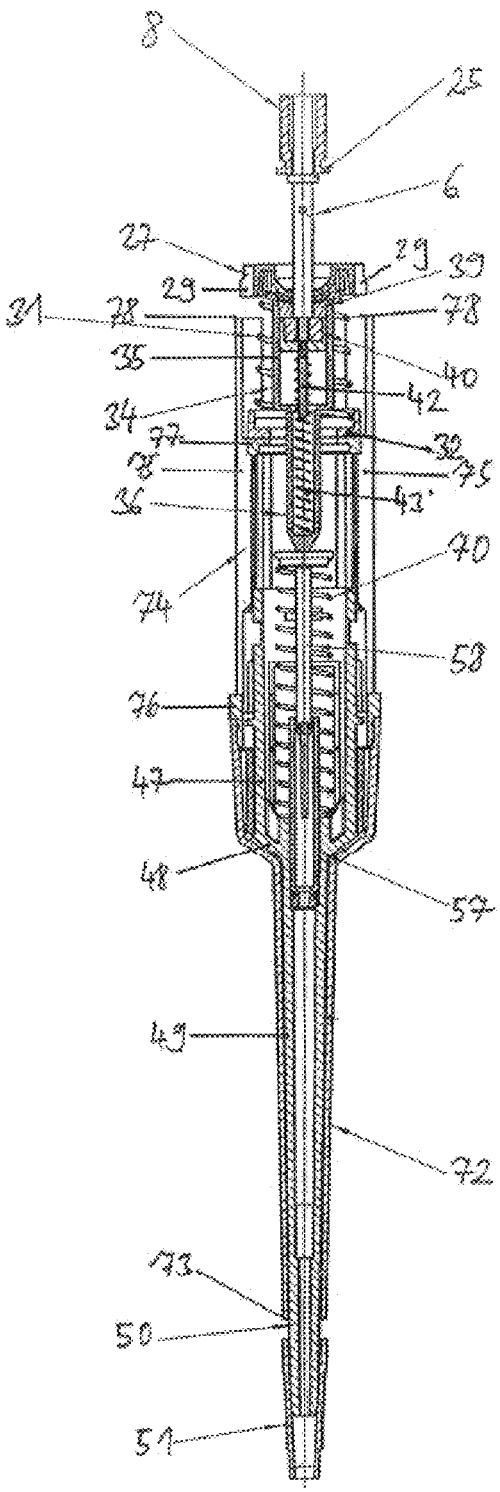
FIG. 6 the same pipette without lifting body in a magnified longitudinal section through a lower portion.
Figure 7:
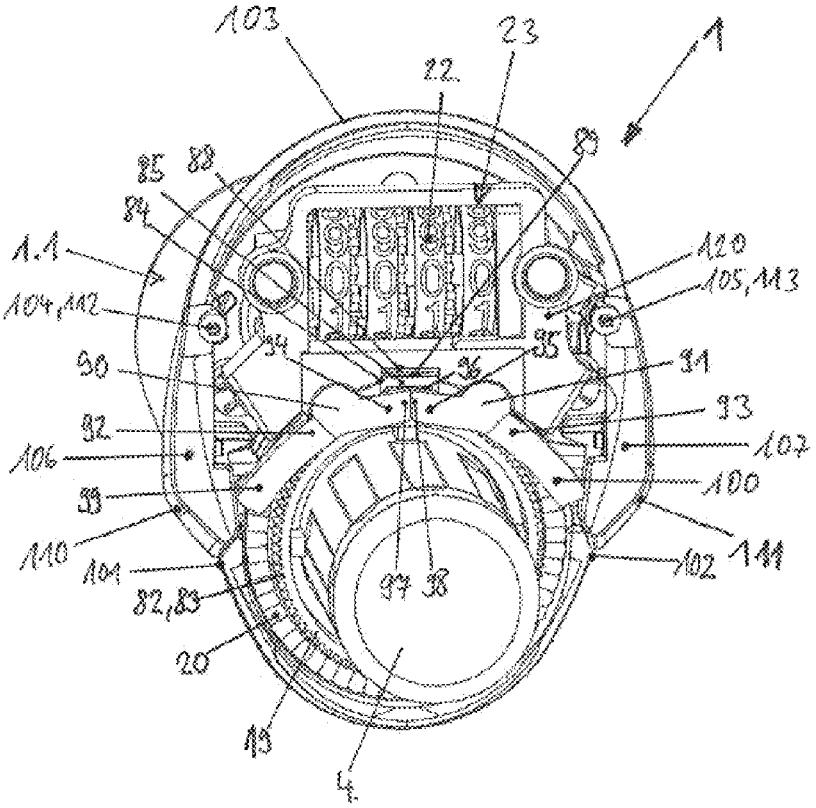
FIG. 7 transmission part with counter mechanism and locking equipment in the casing of the pipette with casing cover taken off, in a perspective view skew from the top and from the side.
Figure 8:
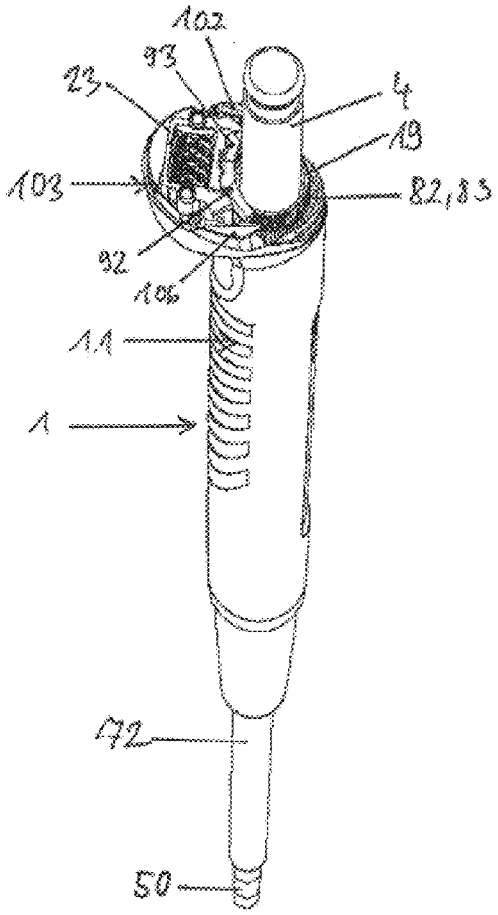
FIG. 8 the same arrangement from another perspective.
Figure 9:
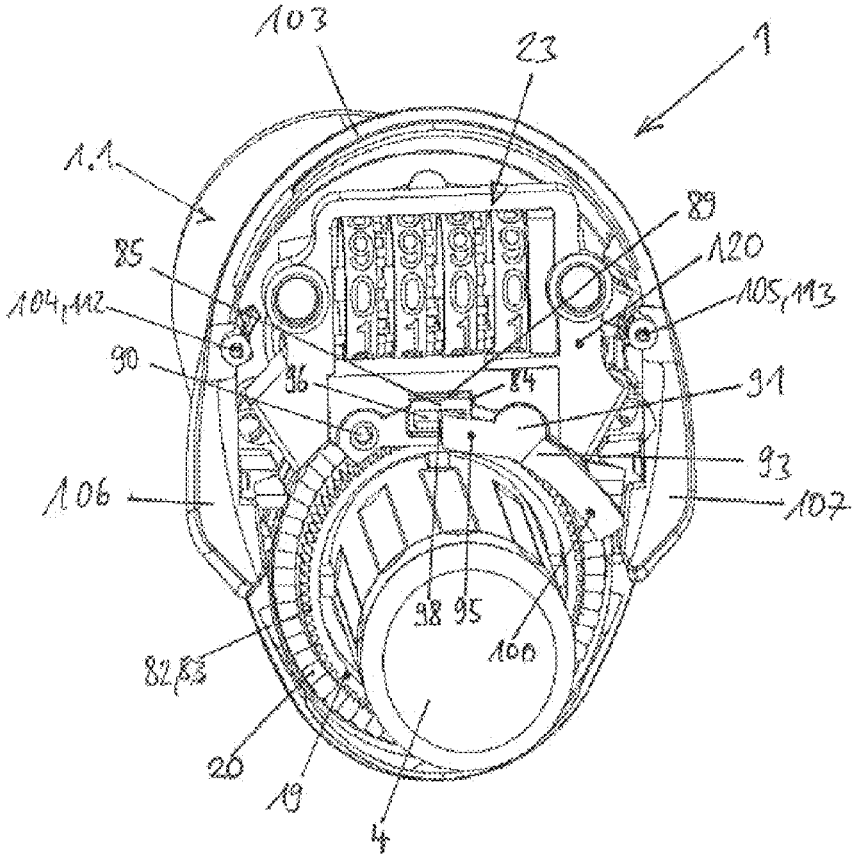
FIG. 9 transmission part with counter mechanism and parts of the locking equipment in the casing of the pipette, in a perspective view skew from the top and from the side.
Figure 10:
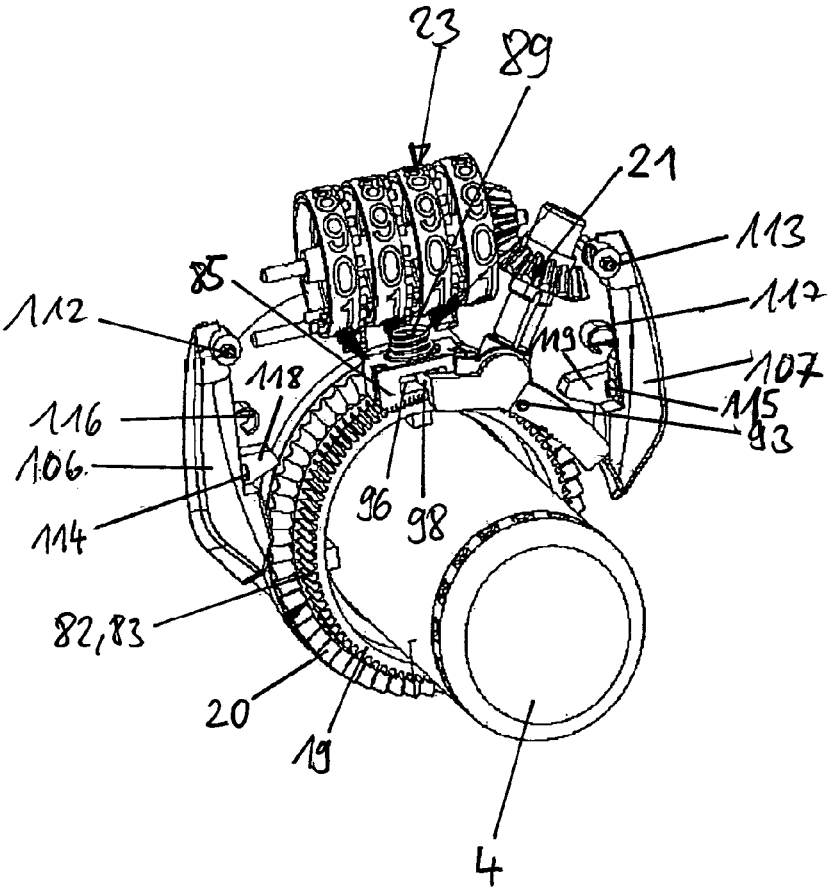
FIG. 10 transmission part with parts of the counter mechanism and locking equipment, in a perspective view skew from the top and from the side.
Figure 11:
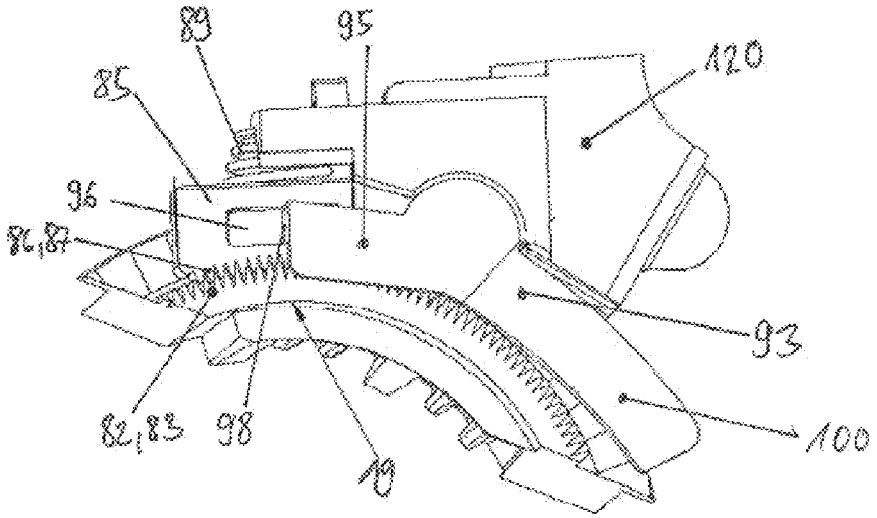
FIG. 11 transmission part with locking equipment in a magnified partial view from the top.
Figure 12:
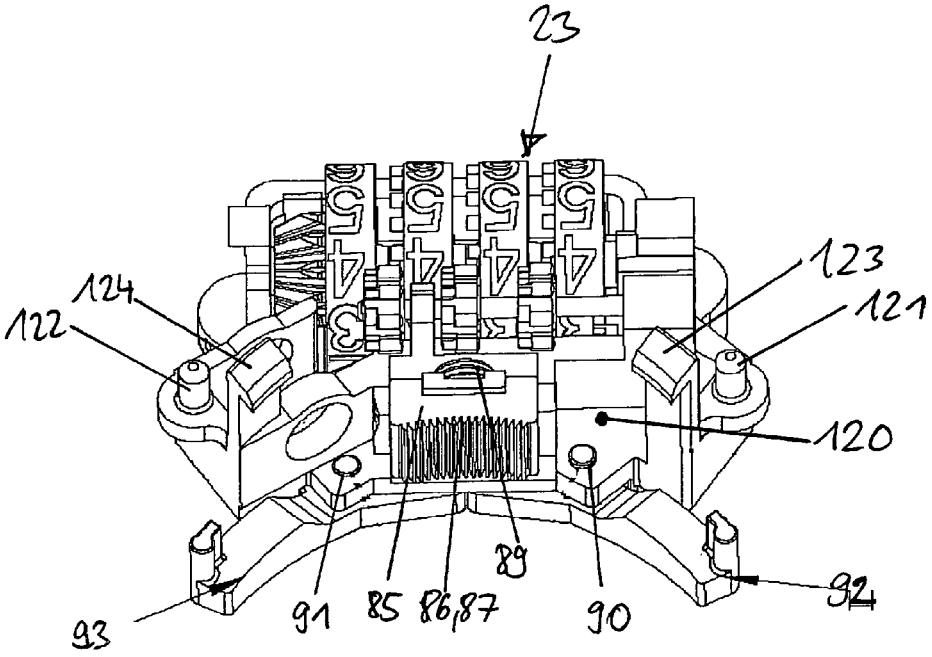
FIG. 12 counter mechanism with locking equipment in a magnified partial view skew from the bottom.
Figure 13:
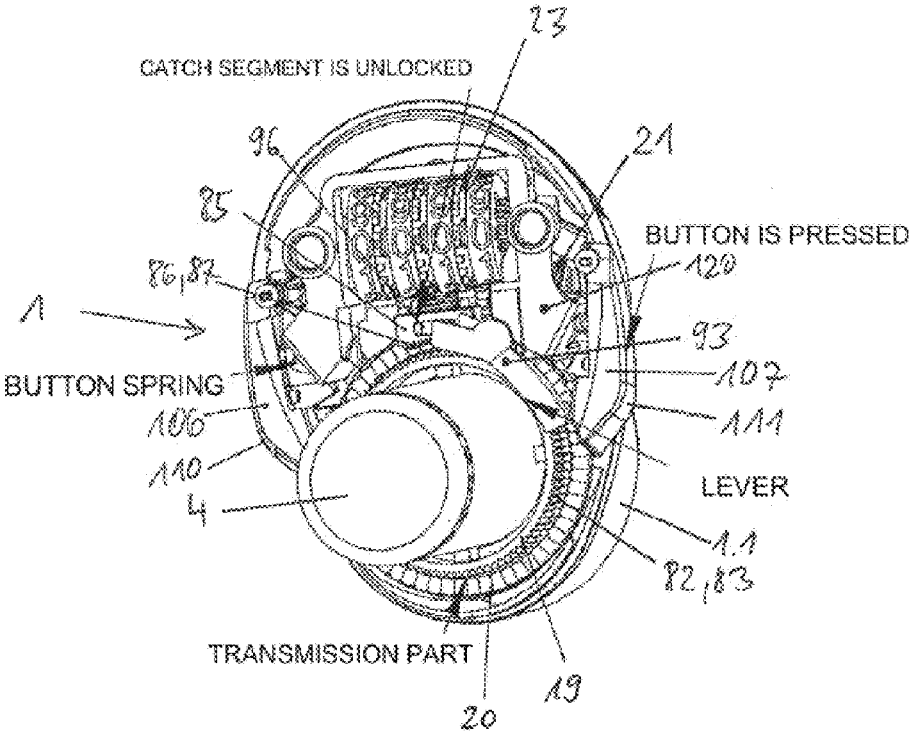
FIG. 13 transmission part with counter mechanism and parts of the locking equipment in the unlocked condition, in a perspective partial view skew from the top and from the side.
Figure 14:
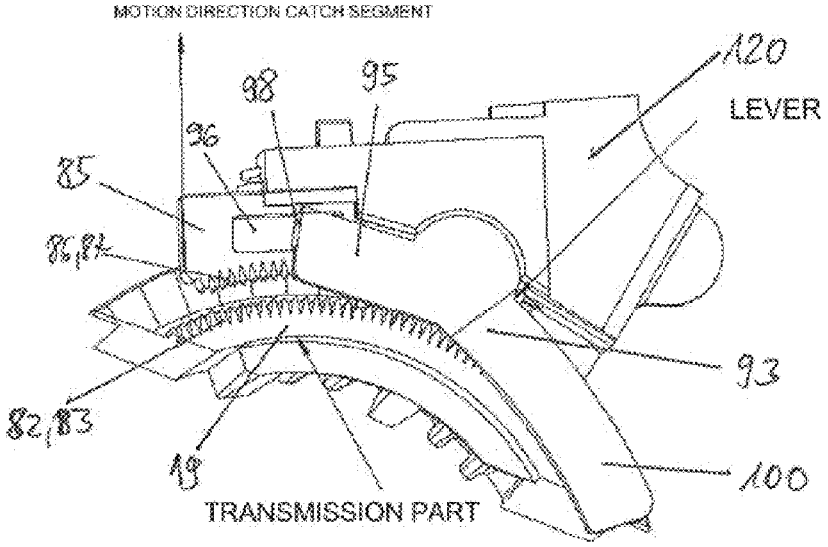
FIG. 14 transmission part with locking equipment in the unlocked condition, in a magnified partial view from the top.

Below the upper ejection spring support 77, three bridges 79 project from the inner side of the upper part 2 of the casing, which are uniformly distributed over the inner circumference and grasp through recesses of the lifting bodies 10. This is shown in FIG. 4 in particular. The bridges 79 form a lower ejection spring support 80. An ejection spring 81, formed as a helical spring, is disposed under bias between the upper ejection spring support 77 and the lower ejection spring support 80 and presses the ejection device 71 upward, so that the upper ejection spring support 77 sits close on the overstroke spring support 32.

The lower part 3 of the casing is guided into the lower casing opening 45 of the upper part 2 of the casing with an upper region of the hollow cylindrical portion 47. The means 46, 54 for detachable connection of the lower part 3 of the casing and the upper part 2 of the casing are detachably connected to each other. The drive element 34 engages with the tip 37 into the upper casing opening 67 and sits close to the piston disc 63 in the indentation 63. The piston disc 63 pushes the drive element 34 upward, and via the uncoupling device 44, the lifting rod 6 is pressed against the threaded spindle 8 with the collar.

According to FIGS. 7 to 14, the transmission part 19 has an annular locking element 82 on its outer circumference above the toothed ring with axially directed teeth. The locking element 82 comprises a toothed ring 83 with radially outward directed teeth. The toothed ring 83 has a finer spacing than the toothed ring 20. For instance, the toothed ring 20 is provided with 60 teeth, and the toothed ring 83 with 180 teeth.

A locking body 85 is arranged next to the toothed ring 83 in a radially directed guiding 84. The locking body 85 is in general cube-shaped and has a limb-cylindrical acting surface 86 on the side facing the toothed ring 83. The limb-cylindrical acting surface 86 is provided with a toothed ring 87 with radially inward directed teeth. In the example, the toothed ring 87 has a number of 18 teeth.

A spring support 88, fixedly connected to the casing 1.1, is arranged at the end of the radial guiding 84. A spring element 89 in the form of a conical wire spring is arranged between spring support 88 and the outer side of the locking body 85. The spring element 89 pushes the locking body 85 under bias against the locking element 82 into a locking position in which the toothed ring 87 engages the toothed ring 83.

Further, two-arm levers 92, 93 are mounted in drag bearings 90, 91 that are fixedly connected to the casing, each of them acting on the locking body 85 with a first lever arm 94, 95. For this purpose, the locking body 85 has a groove-shaped recess 96 on the top, into which engage cams 97, 98 that project from the bottom side of the first lever arms 94, 95. The levers 92, 93 each comprise a second lever arm 99, 100 which extends towards opposing side walls 101, 102 of a casing head 103. On the level of the toothed rings 20, 83, the casing head 103 projects laterally with respect to the rod-shaped casing, and seen from the top it has an essentially oval shape.

The toothed wheel of the counter gear system engaged to the toothed ring 20 is arranged below the two-arm lever.

Further, unlocking elements 106, 107 in the form of further levers are mounted in further drag bearings 104, 105 that are fixedly connected to the casing 1.1. The further levers 106, 107 are configured as one-arm levers in this realisation example. They engage laterally into breakthroughs of the casing head 103 and project laterally from the casing head 103 with an actuating portion 110, 111. The further drag bearings 104, 105 of the further levers 106, 107 are bearing lugs into which engage portions of shafts 112, 113, projecting from the bottom side of the further levers 106, 107. Further, the further drag bearings 104, 105 comprise not shown further bearing lugs in the casing cover, into which engage portions of shafts 112, 113, projecting from the upper side of the further levers.

Furthermore, further spring elements 116, 117 in the form of leaf springs are arranged between further spring supports 114, 115, fixedly connected to the casing, and the further levers 106, 107. The further spring elements 116, 117 are fixed on the inner surfaces of the further levers 106, 107. The further spring elements push the further levers 106, 107 with the actuating portions 110, 111 out of the breakthroughs in the casing head 103, until the further levers 106, 107 bear against the limiting wall of the casing head with a stop element 118, 119 that projects from the bottom side.

The two-arm levers 92, 93 bear against the inner side of the further levers 106, 107 with the outer edges of their further lever arms 99, 100.

A base board 120 is arranged in the casing head 103. The counter mechanism 23 and the counter gear system 21 are mounted thereon. The radial guiding 84 as well as the drag bearings 90, 91 and the bearing lugs of the further drag bearings 104, 105 are formed in the base board 120.

The base board 120 is fixed in holes of the casing 1.1 via mandrels 121, 122.

Further, the base board is connected to complementary recesses in the casing via snap hooks 123, 124.

Figure 15:
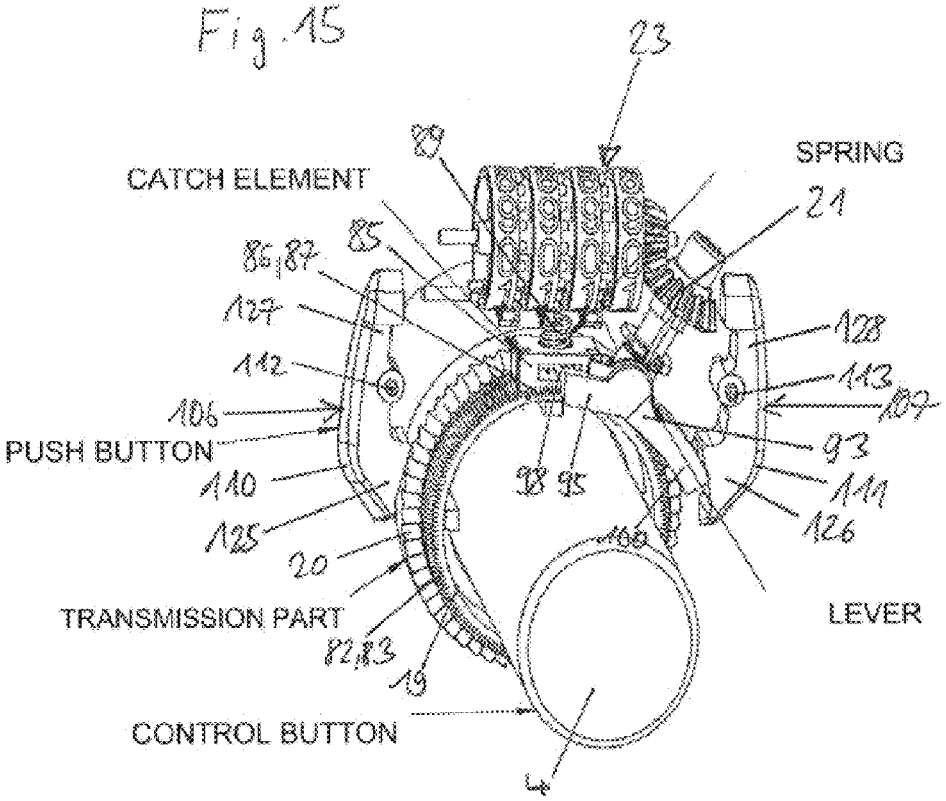
FIG. 15 transmission part with parts of the counter mechanism and parts of a variant of the locking equipment, in a perspective view skew from the top and from the side.
Figure 16:
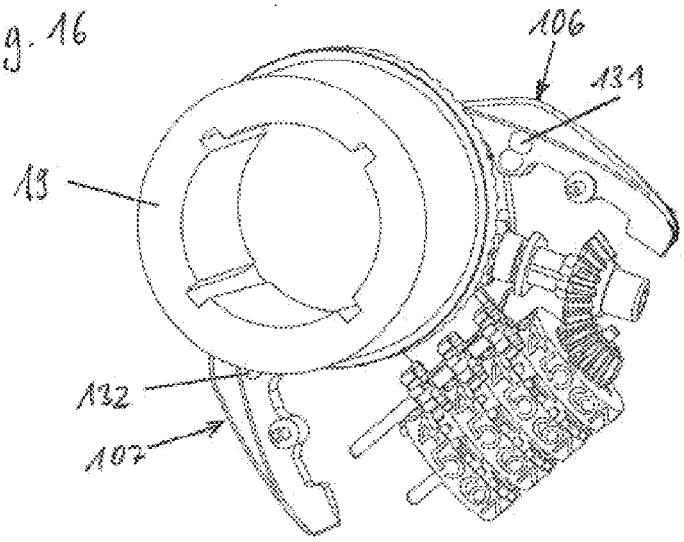
FIG. 16 the component parts of FIG. 15 without the control button, in a perspective view skew from the bottom and from the side.
Figure 17:
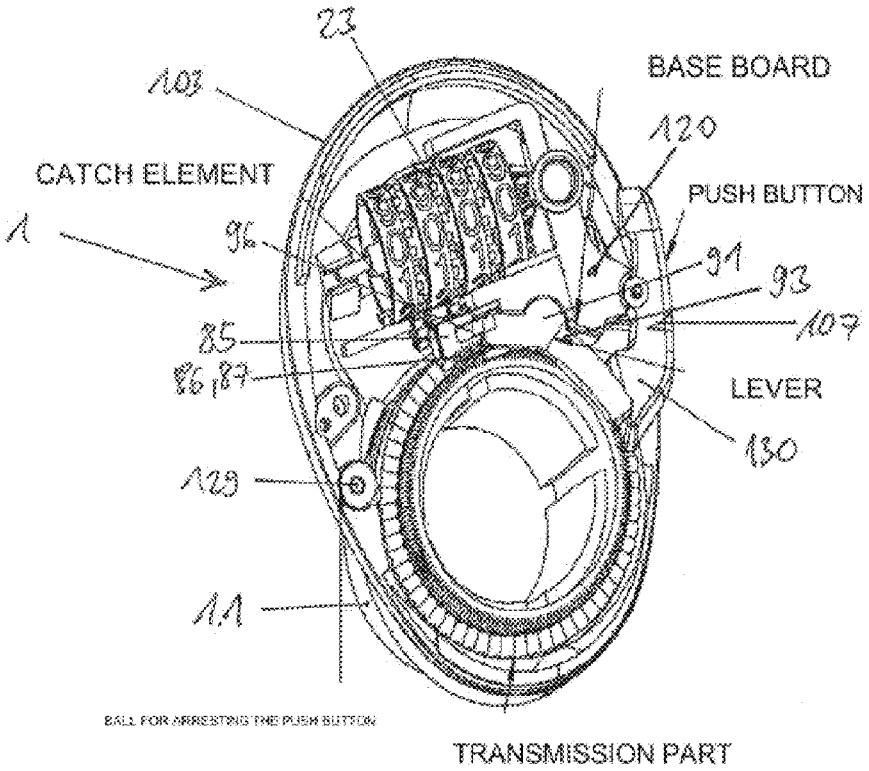
FIG. 17 the component parts of FIG. 15 in the unlocked condition in the casing of the pipette with casing cover taken off, in a perspective view skew from the top and from the side.

The construction example of FIG. 15-17 differs from that one described above in that the further levers 106, 107 are also formed as two-arm levers, which contact the outer edge of the levers with a further first lever arm 125, 126. They are pushed into this position by way of a further spring element 116, 117, which is arranged between a bearing, fixedly connected to the casing, and a further second lever arm 127, 128 of the further levers 106, 107.

Further, spring loaded balls 129, 130 are integrated into the casing 1.1, which partly project upward. Corresponding holes 131, 132 on the bottom sides of the two further levers 106, 107 are associated to the spring loaded balls 129, 130, they receive the spring loaded balls 129, 130 in an unlocking position.

Figure 18:
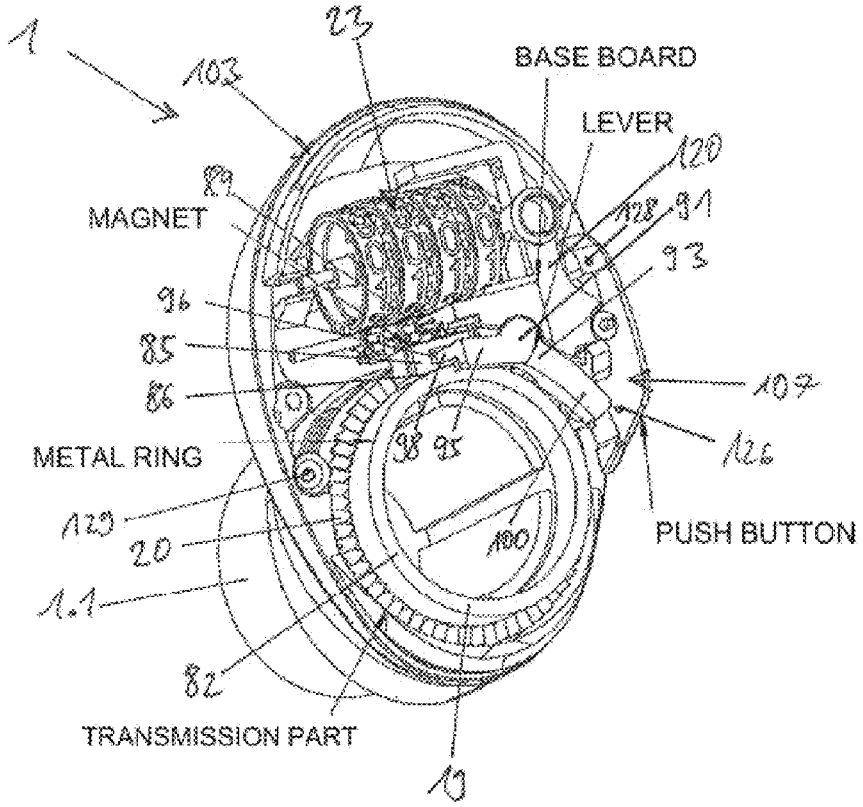
FIG. 18 transmission part with parts of the counter mechanism and parts of a further variant of the locking equipment in the casing of the pipette with casing cover taken off, in a perspective view skew from the top and from the side.
Figure 18:
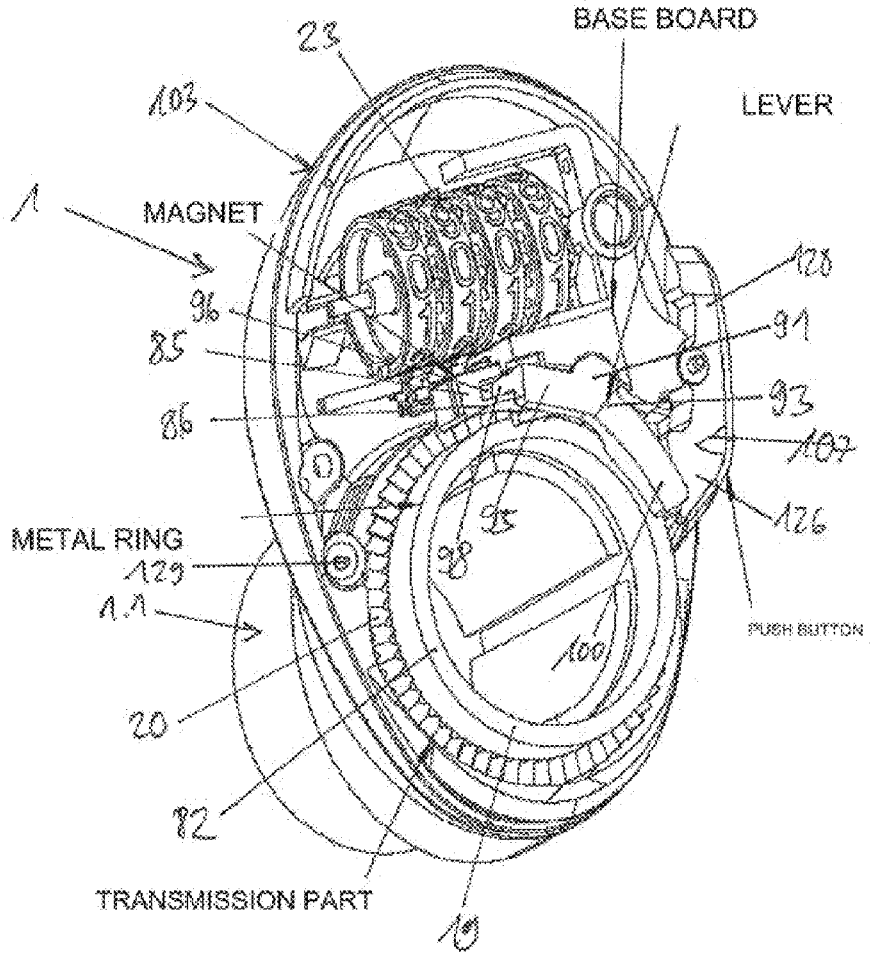

The construction example of FIG. 18-19 differs from that one described above in that the locking element 82 is formed as a ferromagnetic metal ring on the transmission part 19, and the locking body 85 as a magnet with annular cylindrical acting surface 86.

In all the construction forms, the locking body 85 prevents or hinders a twisting of the transmission part 19 in the locking position of FIGS. 7 to 11, FIGS. 15 and FIG. 18. By pressing against the actuating portion 110, 111 of an unlocking element or of a further lever 106, 107, the levers 92, 93 are swung and the locking body 85 is moved in the radial direction, out of the locking position into the unlocking position in which the locking body 85 does not block the locking element 82. This is shown in FIGS. 13, 14, 16 and 19.

In the construction example of FIG. 7-14, the further lever 106, 109 must be kept in the unlocking position, so that the locking body 85 is not moved back into the locking position by the spring element 89. In the construction examples of FIG. 15-19, the catch by means of the ball 129, 130 retains the further lever 106, 107 in the unlocking position, so that it can also be unloaded. Thereafter, a new locking takes place in the construction example of FIG. 7-14, by unloading the further lever 106, 107, and in the construction examples of FIG. 15-19 by pressing on the further lever arm 127, 128 of the further lever 106, 107, so that the catch in the unlocking position is released. The construction form of FIGS. 18 and 19 can be realised without spring element 89, because the locking body 85 is relocated into the locking position by the magnetic forces.

In all the construction examples, the unlocking may take place by actuating one of the two levers. Thus, right handed and left handed persons have the possibility to choose that lever which permits the easiest operation.

The pipette 1 can be used as follows:

It is grasped on the upper part 2 of the casing.

At first, the locking is released by actuating one of the unlocking elements 106, 107. Thereafter, the transmission element 9 and thus the actuating element 4, connected so as to rotate with it, can now be rotated.

A metering stroke is set by rotating the actuating element 4 until the counter wheels 22 indicate the desired metering volume. When the actuating element 4 is being rotated, the threaded spindle 8 is rotated via the spindle driving tenon 11, and is axially relocated due to its thread connection to the spindle nut 9 which is stationary in the upper part 2 of the casing. In this, the spindle driving tenon 11 slips into the hexagon socket of the actuating element 4. At the same time, the transmission part 19 is rotated via the further radial projections 15, 16, and the counter mechanism 23 is adjusted. As a consequence, the set axial position of the threaded spindle 8 in the upper part 2 of the casing, and thus also the metering volume, can be read on the counter mechanism 23.

After setting the metering volume, the locking of the locking body 85 to the transmission part 19 is restored, in the construction example of FIG. 7-14 by unloading the unlocking element 106, 107, and in the construction examples of FIG. 15-19 by actuating the further second lever arm 127, 128 of the further lever 106, 107. Through this, the transmission part 19, and with it the actuating element 4, are prevented from unintended twisting, or the unintended twisting is made difficult.

Further, a pipette tip 51 is clamped onto the neck 50, preferably by pushing the latter into the pipette tip 51 which is held ready in a holder.

Before sucking up liquid, air is ejected out of the cylinder 57 by pushing the piston 58 downward by means of the actuating element 4, until the further collar 38 hits the lower stop body 27. In this, the lifting rod 6 moves the drive element 34 downward via the uncoupling device 44, and the piston 58 is pressed deeper into the cylinder 57. Due to the force between magnet 40 and anchor 39, the uncoupling device 44 does not uncouple in this.

Thereafter, the lower end of the pipette tip 51 is dipped into the liquid by means of the pipette 1, and the desired amount is sucked into the pipette tip 51 by releasing the actuating element 4. In this, the piston spring 70 pushes the piston 58, and with it the drive element 34 as well as the lifting rod 6, back into the initial position in which the collar 25 bears against the threaded spindle 8.

The pipette 1 is shown in FIGS. 1, 2, 5, 6 and 20*a* in this situation.

Figure 20:
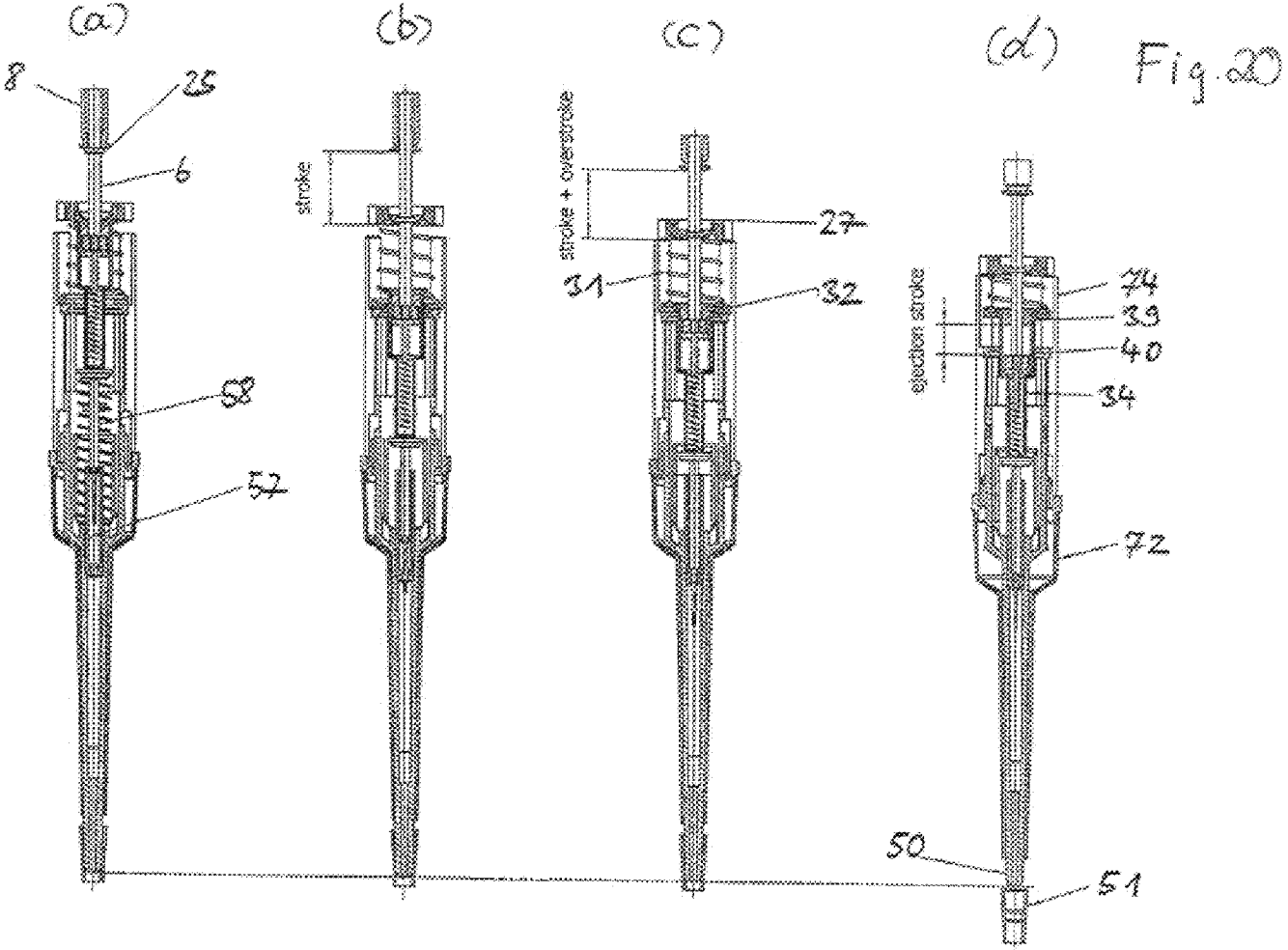
FIG. 20*a* to *d* the same pipette before the actuation of the actuating element (FIG. 20*a*), after the complete execution of the metering stroke and before the execution of the overstroke (FIG. 20*b*), after the execution of the overstroke before the ejection of the pipette tip (FIG. 20*c*) and after the ejection of a pipette tip (FIG. 20*d*), always in a partial longitudinal section.

Thereafter, the pipette tip 51 can be directed to another vessel with its lower end by means of the pipette 1. By pushing the actuating element 4 downward, the lifting rod 6 is moved downward and the drive element 34 is relocated downward via the uncoupling device 44, so that the piston 58 is moved downward in the cylinder 57 anew. In this, the set metering amount is essentially delivered. This situation is shown in FIG. 20*b*.

Residuals that have remained in the pipette tip 51 can be blown out by pushing the actuating element 4 further downward under increased expense of force. In this, the lower stop body 27 is relocated downward in the guide slots 30 against the action of the overstroke spring 31, and via the uncoupling device 44, the drive element 34 is relocated further downward and pushes the piston 58 still deeper into the cylinder 57. In the overstroke, a further positive pressure is generated, which pushes out residual liquid which is adhered on the inner wall pipette tip 51.

The overstroke is ended when the drive element 34 hits with the further collar 38 the overstroke spring support 32 which forms the end stop. At the same time, the projections 29 reach the actuating end 78 of the ejection lengthening 74 or are situated above it in a very small distance. This situation is shown in FIG. 20*c*.

Thereafter, the pipette tip 51 can be ejected. For this purpose, the actuating element 4 is pushed further downward with increased expense of force. The overstroke spring 32 prevents the drive element 34 from continuing the downward motion. By the increased force, the magnet 40 is detached from the anchor 39 and the lifting rod 6 moves further downward and takes the lower stop body 27 along. With the projections 29, the lower stop body 27 pushes the ejection lengthening 74 downward on the actuating ends 78. The ejection lengthening 74 takes the ejection slide 72 along towards the downside, which pushes the pipette tip 51 off from the neck 50 with its ejection end 73.

During the ejection stroke, the piston 58 is not moved downward any further in the cylinder 57. As a result, no clearance volume is needed in the cylinder 57 at the downside, and the piston 58 does not hit the bottom of the cylinder 57. When the magnet 40 is released from the anchor 39, the force for relocating the actuating element 4 further downward is reduced again. The ejection is ended when the ejection lengthening 74 hits a not depicted ejection stop in the casing. This situation is shown in FIG. 20*d*.

After releasing the actuating element 4, the pipette 1 reverts automatically into the starting position of FIGS. 1, 2, 5, 6 and 20*a*. In this, an ejection spring pushes the ejection lengthening 74 upward, and with it the ejection slide 72. Further, the uncoupling spring 43 pushes the lifting rod 6 with the magnet 40 upward, until the magnet 40 is retained on the anchor 39 by the magnetic forces. Further, the overstroke spring 31 pushes the lower stop body 27 upward until the projections 29 have reached the upper ends of the guide slots 30. Further, the piston spring pushes upward the piston 58, the drive element 34 and via the uncoupling device 44 the lifting rod 6, until the collar 25 bears against the threaded spindle 8.

In a further variant, the uncoupling device 44, 43 can be omitted in order to perform stroke, overstroke and ejection stroke. The lifting rod 6 acts directly on the conical indentation 64 of the piston 58.

The upper part 2 of the casing can be connected quite simply with another, lower part 3 of the casing, so as to form a casing wherein the cylinder 57 and the piston 58 have another cross section. Correspondingly, the same upper part 2 of the casing can be used for making pipettes 1 having different metering volumes. Further, it is possible to replace the lower part 3 of the casing or the upper part 2 of the casing easily in case of a trouble, or to equip the upper part 2 of the casing with another lower part 3 of the casing if needed. In addition, the lower part 3 of the casing can be removed easily from the upper part 2 of the casing for purposes of maintenance, repair and cleaning.

This completes the description of the preferred and alternate embodiments of the invention. Those skilled in the art may recognize other equivalents to the specific embodiment described herein which equivalents are intended to be encompassed by the claims attached hereto.

LIST OF THE USED REFERENCE SIGNS

1 pipette
1.1 casing
2 upper part of the casing
3 lower part of the casing
4 actuating element
5 cover of the actuating element
6 cylindrical lifting rods
7 upper passage channel
8 threaded spindle
9 spindle nut
10 lifting body
11 spindle driving tenon
12 hexagon
13 hole
14 hexagon socket
15, 16 radial projections
17, 18 grooves
19 transmission part
20 toothed ring
21 counter gear system
22 counter wheels
23 counter mechanism
24 casing cover
25 bead-like collar
26 lower front side
27 lower stop body
28 lower passage channel
29 projections
30 guide slots
31 overstroke spring
32 overstroke spring support
33 guide-through hole
34 drive element
35 upper sleeve portion
36 lower sleeve portion
37 tip in the shape of a truncated cone
38 further collar
39 hollow cylindrical anchor
40 hollow cylindrical magnet
41 pot
42 needle-shaped portion
43 uncoupling spring
44 uncoupling device
45 lower casing opening
46 means for detachable connection
47 hollow cylindrical portion
48 upper hollow cone portion
49 lower hollow cone portion
50 conical neck
51 pipette tip
52 upper opening
53 lower opening
54 further means for detachable connection
55 extension
56 connection channel
57 cylinder
58 piston
59 O-ring
60 piston seal
61 needle-shaped extension
62 passage opening
63 piston disc
64 conical indentation
65 cylindrical closing cap
67 upper casing opening
68 projections
69 indentation
70 piston spring
71 ejection device
72 ejection slide
73 ejection end
74 ejection lengthening
75 ejection rod
76 ejection ring
77 upper ejection spring support
78 actuating end
79 bridge
80 lower ejection spring support
81 ejection spring
82 locking element
83 toothed ring with radially outward directed teeth
84 radial guiding
85 locking body
86 acting surface
87 toothed ring with radially inward directed teeth
88 spring support
89 spring element
90 drag bearing
91 drag bearing
92 two-arm lever
93 two-arm lever
94 first lever arm
95 first lever arm
96 recess
97 cams
98 cams
99 second lever arm
100 second lever arm
101 side wall
102 side wall
103 casing head
104 further drag bearing
105 further drag bearing
106 unlocking element (further lever)
107 unlocking element (further lever)
110 actuating portion
111 actuating portion
112 shaft
113 shaft
114 further spring support
115 further spring support
116 further spring element
117 further spring element
118 stop element

119 stop element
120 base board
121 mandrel
122 mandrel
123 snap hook
124 snap hook
125 further first lever arm
126 further first lever arm
127 further second lever arm
128 further second lever arm
129 spring loaded ball
130 spring loaded ball
131 hole
132 hole

The invention claimed is:

1. A pipette comprising:

a rod-shaped casing (1.1), a seat (50) for detachably holding a pipette tip (51) on the lower end of the casing (1.1), a displacement equipment, comprising a displacement chamber (57) with a limit (58) that is relocatable therein, a connection channel (56), connecting the displacement chamber (57) with an opening in the seat (50), a drive equipment (6), coupled to the relocatable limit (58), for relocating the relocatable limit (58) of the displacement chamber, adjustable means (8, 25, 27) for limiting the relocation of the relocatable limit (58) by the drive equipment (6), an actuating element (4), connected to the drive equipment (6) and projecting out from the upper end of the casing (1.1), for controlling a relocation of the relocatable limit (58) by relocation along an axis, and for adjusting the adjustable means (8, 25, 27) for limiting by rotating the actuating element (4), a cylindrical transmission part (19), which is rotatable in the casing (1.1) and bearing mounted at a certain position in the axial direction, wherein the actuating element (4) is relocatable in an axially extending accommodation of the transmission part (19) and is connected to the transmission part (19), so as to rotate together with it, via means (15, 16, 17, 18) for rotation-blocked connection, first means (11, 14) for transmitting a rotational movement of the actuating element (4) to a movement for adjusting the adjustable means for limiting (8, 25, 27) the relocation, coupled to the actuating element (4) and the adjustable means for limiting (8, 25, 27) the relocation, adjustable means (23) for indicating a metering volume with a display (22) that is visible from the outside, second means (20, 21) for transmitting a rotational movement of the transmission part (19) to a movement for adjusting the adjustable means for indicating (23), coupled to the transmission part (19) and the adjustable means for indicating (23), an annular cylindrical locking element (82) on the outer circumference of the transmission part (19), a locking body (85) with a partly cylindrical acting surface (86), which bears against the circumference of the locking element (82) in the locking position, means (89) for relocating the locking body (85) into the locking position, at least one unlocking element (106, 107), projecting from the casing (1.1) and being movably mounted with respect to the casing (1.1), and third means (92, 93) for transmitting a movement of the unlocking element (106, 107) with respect to the casing (1.1) to a movement, away from the locking element (82), of the locking body (85) from out the locking position, the third means (92, 93) for transmitting being coupled to the locking body (85) and the unlocking element (106, 107).

2. The pipette according to claim 1, which comprises unlocking elements (106, 107), projecting from the casing (1.1) on side walls (101, 102) of the casing (1.1) facing away from each other, each of them being coupled to the locking body (85) via third means (92, 93) for transmitting, in order to relocate the locking body (85) away from the locking element (82) by actuating the one or the other unlocking element (106, 107) at option.

3. The pipette according to claim 1, wherein the locking element (82) is a toothed ring (83) on the circumference of the transmission part (19) with radially outward directed teeth, and the locking body (85) has a toothed ring (87) with radially inward directed teeth on the partly cylindrical acting surface (86), which engage into the teeth of the locking element (82) in the locking position.

4. The pipette according to claim 3, wherein the locking body (85) has at least 5 and/or at most 35 teeth.

5. The pipette according to claim 4, wherein the locking body has at least 15 and/or at most 25 teeth.

6. The pipette according to claim 1, wherein the locking element (82) is ferromagnetic and the locking body (85) is magnetic.

7. The pipette according to claim 1, wherein the locking element (82) is a brake cylinder and the locking body (85) is a brake shoe.

8. The pipette according to claim 1, wherein the third means (92, 93) for transmitting comprise a two-arm lever with a first lever arm (94, 95), acting on the locking body (85), and a second lever arm (99, 100), which either acts on the unlocking element (106, 107) or is itself the unlocking element (106, 107).

9. The pipette according to claim 8, wherein means (129, 130, 131, 132) for arresting the further lever (106, 107) in an unlocking position exist between the further lever (106, 107) and the casing (1.1).

10. The pipette according to claim 1, wherein the lever arms (94, 95, 99, 100) of the two-arm lever (92, 93) are inclined towards each other in an obtuse angle, and/or extend in an arc around the actuating element (4).

11. The pipette according to claim 1, wherein the unlocking element (106, 107) has a further lever, pivotally mounted in the casing (1.1), with a lever arm (125, 126) acting on the third means (92, 93) for transmitting and an actuating portion (110, 111) protruding from the casing.

12. The pipette according to claim 1, wherein the means for relocating the locking body (85) into the locking position comprise a spring element (89) which loads the locking body (85) in the locking position and is supported in a spring support (88) that is fixedly connected to the casing (1.1).

13. The pipette according to claim 1, wherein the second means (20, 21) for transmitting comprise a toothed ring with axially directed teeth on the outer circumference of the transmission part (19), into which engages a toothed wheel of the means (23) for indicating.

14. The pipette according to claim 1, wherein the drive equipment (6) comprises an axially relocatable lifting rod for relocating the relocatable limit (58) of the displacement equipment, the adjustable means (8, 25, 27) for limiting comprise an upper stop body (8), relocatable in the axial direction of the lifting rod (6), a lower stop body (27) and a stop element (25), disposed on the circumference of the lifting rod (6) between the upper and the lower stop body, for limiting the stroke of the lifting rod, and the actuating element (4) is connected to the lifting rod (6).

15. The pipette according to claim 14, wherein the upper stop body (8) is a threaded spindle which has an upper passage channel (7) through which the lifting rod (6) is guided through and which is screwed into a spindle nut (9) that is fixedly connected to the casing (1.1), wherein the lower stop body (27) has a lower passage channel (28) through which the lifting rod (6) extends, and wherein the lifting rod (6) with the stop element (25) can be relocated between the upper stop body (8) and the lower stop body (27).

16. The pipette according to claim 15, wherein the first means (11, 14) for transmitting are further means for connecting the actuating element (4) to the threaded spindle (8) so as to rotate together with it, which permit axial relocation of the actuating element (4) with respect to the threaded spindle (8).

17. The pipette according to claim 15, wherein the further means for connecting the actuating element (4) to the threaded spindle (8) so as to rotate together with it comprise a polygon which engages into a complementary, axially extending accommodation of the actuating element (4).

18. A pipette according to claim 1, wherein one or several of the following component parts are entirely or partially mounted on a base board (120) which is fixed in the casing (1.1):

a counter mechanism (23),
a counter gear system (21)
said locking body (85),
a lever (92, 93),
a further lever (106, 108),
a spring element (89), and
a further spring element (116, 117).

* * * * *